United States Patent [19]

Leblanc et al.

[11] 4,398,518

[45] Aug. 16, 1983

[54] FUEL INJECTION APPARATUS FOR INTERNAL COMBUSTION ENGINES, IN PARTICULAR FOR DIESEL ENGINES

[75] Inventors: Jean Leblanc, Lyons; Jean Pigeroulet, Villeurbanne, both of France; Max Straubel, Stuttgart, Fed. Rep. of Germany

[73] Assignee: Robert-Bosch GmbH, Stuttgart, Fed. Rep. of Germany

[21] Appl. No.: 223,889

[22] Filed: Jan. 27, 1981

[30] Foreign Application Priority Data

Jan. 12, 1980 [DE] Fed. Rep. of Germany ..... 3000977

[51] Int. Cl.[3] ..... F02M 39/00

[52] U.S. Cl. ..... 123/446; 123/458; 123/459; 123/460

[58] Field of Search ..... 123/446, 458, 459, 460

[56] References Cited

U.S. PATENT DOCUMENTS

| | | | |
|---|---|---|---|
| 3,011,489 | 12/1961 | Bessiere | 123/446 |
| 3,358,662 | 12/1967 | Kulke | 123/449 |
| 3,404,668 | 10/1968 | Eheim et al. | 123/449 |
| 3,465,737 | 9/1969 | Dreisin | 123/453 |
| 3,486,493 | 12/1969 | Dreisin | 123/448 |
| 3,486,494 | 12/1969 | Dreisin | 123/457 |
| 3,620,647 | 11/1971 | Hofer et al. | 123/446 |
| 3,667,438 | 6/1972 | Moulin et al. | 123/447 |
| 3,699,939 | 10/1972 | Eckert et al. | 123/459 |
| 3,921,604 | 11/1975 | Links | 123/458 |
| 4,129,253 | 12/1978 | Bader, Jr. et al. | 239/88 |
| 4,249,497 | 2/1981 | Eheim et al. | 123/446 |

FOREIGN PATENT DOCUMENTS 1185828 11/1957 France ..... 123/446

*Primary Examiner*—Ira S. Lazarus
*Assistant Examiner*—Magdalen Moy
*Attorney, Agent, or Firm*—Edwin E. Greigg

[57] ABSTRACT

A fuel injection apparatus for internal combustion engines is proposed (FIG. 1), in which the onset and end of injection are determined by a hydraulically actuated control slide. The injection pumps of the apparatus, which are preferably combined with an injection nozzle to make a pump/nozzle unit, having a central magnetic valve assembly comprising two magnetic valves switched hydraulically in parallel, which valve assembly is inserted in a connection between a control pressure line, which can be placed under control pressure ($P_S$) from a source of control fuel, and a low-pressure line which is under supply pressure ($P_V$). In order to initiate the onset of injection, the control slide is placed under control pressure ($P_S$) by the valve assembly via a distributor apparatus and closes an overflow channel leading out of the pump work chamber. In order to control the end of the injection, the control slide, during its return stroke, relieves this overflow channel toward a low-pressure line. The control pressure ($P_S$) in the control pressure line required for actuation of the stroke movement of the control slide is built up by means of the valve assembly as a result of blocking the outflow from this line.

10 Claims, 5 Drawing Figures

FUEL INJECTION APPARATUS FOR INTERNAL COMBUSTION ENGINES, IN PARTICULAR FOR DIESEL ENGINES

BACKGROUND OF THE INVENTION

The invention is based on a fuel injection apparatus for internal combustion engines, and more particularly for Diesel engines. A fuel injection apparatus of this type is already known (U.S. Pat. No. 3,486,493), in which the injection pump is embodied as a pump/nozzle and the fuel injection quantity is determined by means of a hydraulically driven control slide inserted in an overflow channel. This control slide determines the effective supply stroke and develops the fuel injection quantity of the injection pump by means of blocking the return flow out of the pump work chamber; and the injection is terminated when this control slide opens the overflow channel and the injection pressure can be relieved. In this known fuel injection apparatus, the control device which is common for all the injection pumps comprises a mechanical rotary distributor driven in synchronism with the engine camshaft; this rotary distributor determines both the onset and the end of fuel injection, controls an rpm-dependent variation in supply onset via a control sheath which is mechanically displaceable by flyweights, and simultaneously acts as a distributor device by means of which the control fuel is delivered to the various pressure chambers of the control slide. A control device of this kind, mechanically driven, is greatly dependent on rpm; that is, the injected quantity of fuel varies when the rpm is varying despite an unchanged placement of the adjusting members. This limits its applicability in high-speed engines. A further disadvantage is that the control pressure line also acts as a filling line, so that negative influence retroactively exerted on the control of fuel quantity and controlled times must be expected.

A fuel injection apparatus of virtually the same type is also known from U.S. Pat. No. 3,465,737; however, in this apparatus the control slide is actuated by the control pressure of a separate injection pump, acting as a control pump, which is driven simultaneously with the pump/nozzle. In order to vary the injection onset, a known injection adjuster which transmits the drive torque is built into the driven mechanism of the control pump, so that the total cost for this apparatus is very high.

Fuel injection apparatuses having pump/nozzles controlled by magnetic valves are also known, in which the control slide inserted in the overflow channel is embodied by the valve member of a magnetic valve assembly. In these apparatuses, each pump/nozzle has associated with it a magnetic valve directly exposed to the injection pressure, so that there are unavoidable variations in performance from one example to another, and the pressure forces engaging the valve member, when the pump/nozzles are used in multicylinder engines, prevents the provision of an identical supply quantity for each pump/nozzle.

OBJECT AND SUMMARY OF THE INVENTION

It is the object of the invention to obtain a compact injection apparatus, substantially eliminating mechanical control elements while keeping manufacturing costs low, which assures precise metering of fuel quantities and correction of injection onset over a wide rpm range, and which finally can be used in high-speed Diesel engines.

In the fuel injection apparatus according to the invention, both the injection onset and the duration of injection are determined by an electronically triggerable magnetic valve assembly, as a result of which a precise and punctual fuel injection can be attained, because with the electronic control devices which are conventional today, even the extremely short control times required for Diesel injection can be obtained with the necessary precision while taking into consideration the rpm signal of electric rpm sensors. Because the valve assembly controlling the exertion of pressure is separate from the distributor apparatus, the lines and control times which are required can be designed to be optimal, and the control pressure is not unfavorably affected by pressure surges which occur during filling and shutting off of the pump work chambers.

The invention will be better understood and further objects and advantages thereof will become more apparent from the ensuing detailed description of four preferred embodiments taken in conjunction with the drawings.

DESCRIPTION OF THE PREFERRED EMBODIMENTS

Figure 1:
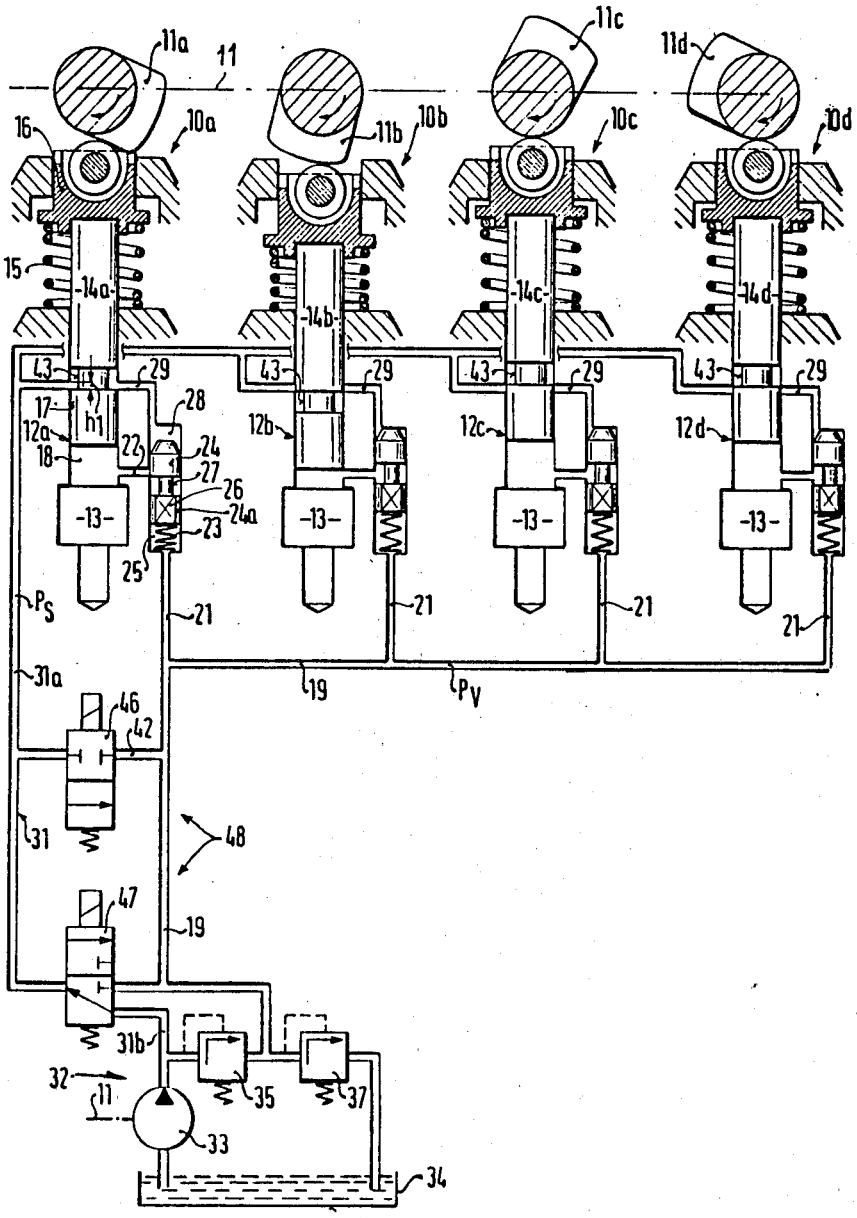
FIG. 1 is a simplified representation of the first exemplary embodiment, having four injection pumps shown in cross section and embodied as pump/nozzles.

In the fuel injection apparatus shown in FIG. 1, there are four mechanically driven pump/nozzles 10*a*–10*d*, which are substantially made up of one injection pump 12*a*–12*d*, embodied as a piston pump and driven by one drive cam 11*a*–11*d* each of an engine camshaft 11, and one injection nozzle 13 combined therewith and embodied as a pressure-controlled injection valve. Any of the known injection valves which are controlled by fuel pressure and are embodied as valves opening either inward or outward may be used as the injection nozzle 13, depending on the requirements of the engine. The pump piston 14*a*, 14*b*, 14*c* and 14*d*, during their compression strokes which are generated counter to a push rod spring 15 by the drive cams 11*a*–11*d* and are transmitted via roller push rods 16, dip into one each of the pump work chambers 18, embodied by a portion of a cylinder bore 17 of the pump pistons 14*a*–14*d*. These pump work chambers 18 are filled with fuel via filling line 21 connected to a supply line 19 which is common to all the pump/nozzles 10*a*–10*b* and is under supply pressure $P_V$. These filling lines 21 are simultaneously also to be considered as extensions of the overflow channels 22 which are connected to the pump work chambers 18. Since in the illustrated embodiment no separate filling lines discharge into the pump work chambers 18, the overflow lines 22 are sumultaneously also to be considered as a portion of the filling lines 21.

A control slide 24 actuatable counter to the force of a restoring spring 23 is inserted into the connection of each overflow channel 22 with the filling line 21. In the case of the pump/nozzle 10*a*, the control slide 24 is in a position which closes the overflow channel 22 in order to initiate the injection; in the case of the other pump-/nozzles 10*b*–10*d*, however, the control slide 24, in its outset position, connecting the pump work chamber 18 with the filling line 21 and thus with the supply line 19 which serves as a low-pressure line, rests on a stop which is not shown in detail. In order to simplify the filling of the lines, the filling lines 21 each discharge into a spring chamber 25 of the control slides 24 containing the restoring spring 23, and the spring chamber 25 is in permanent communication, via channels 26 formed by faces or grooves in a section 24*a* of the control slide 24, with a control location 27 of the control slide 24 which is embodied as an annular groove. In the outset position of the control slide 24 shown in connection with the pump/nozzle 10*b*–10*d*, the annular groove 27 has opened the connection from the filling line 21 to the overflow channel 22; in the case of the first pump/nozzle 10*a*, this connection is closed.

Each of the control slides 24 is limited on its end opposite the restoring spring 23 by a pressure chamber 28, which in turn is connected via a control line 29 to a control pressure line 31 which is common to all the pump/nozzles.

The control pressure line 31 may be placed under the control pressure $P_S$ of a source of control fuel 32, when the fuel supplied from a tank 34 into the control pressure line 31 by a supply pump 33 has its level of pressure determined by a first pressure limitation valve 35. This is the case whenever the control fuel located in the control pressure line 31 is hindered in its flow by a central magnetic valve assembly 48 serving all the pump/nozzles 10*a*–10*b*, so that it cannot flow into a low-pressure line under substantially lower pressure. In the illustrated embodiment, the supply line 19 serves as the low-pressure line in which in the present case the supply pressure $P_V$ prevails. In order to control this supply pressure $P_V$, a second pressure limitation valve 37 is switched subsequent to the first pressure limitation valve 35.

The source of control fuel 32 is thus embodied by the supply pump 33, preferably embodied in turn as a constant-quantity pump, and by the first pressure limitation valve 35, and the control pressure $P_S$ which prevails in the control pressure line when the return flow has been blocked is several times higher than the supply pressure $P_V$ prevailing in the supply line 19 and the filling lines 21. Favorable values for these pressures are approximately $P_V=6$ bar and $P_S=30$–80 bar.

FIG. 1 shows the injection onset position for the first pump nozzle 10*a*, because the fuel located in the pump work chamber 18 is prevented from flowing out into the low-pressure line 19 by means of the control slide 24 blocking the overflow channel 22. In the course of the further downward stroke of the pump piston 14*a*, the fuel compressed within the pump work chamber 18 is subsequently injected via the injection nozzle 13 into the associated engine cylinder. In the case of remaining pump/nozzles 10*b*–10*d*, which are not actuated, the connection from the control pressure line 31 to the pressure chamber 28 of the control slide 24 is blocked by the corresponding position of one annular groove 43 each, serving as a distributor device, on the pump piston 14*b*–14*d*, either in the bottom dead center or the top dead center position of the associated drive cam 11*b*–11*d*. The distributor apparatus embodied by each of the annular grooves 43 on the pump pistons 14*a*–14*d* and the central valve assembly 48 together comprise the control apparatus which controls the onset of supply and the termination of supply of the corresponding pump/nozzle 10*a*–10*d*.

As may be seen from the simplified representation of FIG. 1, the magnetic valve assembly 48 is made up of the two magnetic valves 46 and 47 which are switched in parallel hydraulically, by means of which with an appropriate overlapping of the control signals extremely short control times can be attained, such as cannot be attained with a single magnetic valve.

The first magnetic valve 46 is inserted into a line 42 connecting the control pressure line 31 with the supply line 19. This magnetic valve 46 is embodied as a 2/2-way valve and it is shown in its actuated switching position, that is, its second switching position in which it has been displaced by the associated excited electromagnet; in this position, it blocks the connection from the control pressure line 31 to the supply line 19. The second magnetic valve 47 is a 3/3-way valve and in its non-excited, first switching position shown in FIG. 1, it connects a portion 31*a* of the control pressure line 31 leading to the distributor apparatus 43 with the other portion 31*b* communicating with the source of control fuel 32. In order to terminate the injection and to relieve the control pressure line 31, the second magnetic valve 47, when the electromagnet is excited, switches over into its second switching position in which it connects the portion 31*a* of the control pressure 31 with the supply line 19. Then before the next injection procedure is initiated the first magnetic valve 46, with the electromagnet not excited, returns into its first switching position, indicated in the switch symbol, and the second magnetic valve 47 is moved back into its first switching position shown, again with the electromagnet not excited.

During the relief of the control pressure line 31 effected in order to control the end of injection, the pressure in the control pressure line 31 is reduced to the supply pressure $P_V$, and in the pressure chamber 28 of the first pump/nozzle 10*a*, which still communicates via the annular groove 43 and the control line 29 with the control pressure 31, the pressure is dropped, and the restoring spring 23 can displace the control slide 24 into its outset position. In so doing, the pump work chamber 18 is made to communicate via the overflow channel 22, the control location 27 on the control slide 24, the channels 26, the spring chamber 25 and the filling line 21, with the supply line 19. The pressure drop thus effected in the pump work chamber 18 terminates the injection, and only a standby pressure corresponding to the supply pressure $P_V$ is maintained in the pump work chamber 18. Until the end of the remaining stroke of the pump piston 14*a*, the excess fuel is forced out of the pump work chamber 18 into the supply line 19, and during the subsequent intake stroke this pump work chamber 18 is filled again via the filling line 21 and the overflow line 22. This filling process is terminated once the pump piston 14*a* has returned to its bottom dead center position, as is the case with the pump piston 14*c* and 14*d* of the third and fourth pump/nozzles 10*c* and 10*d*.

The drive cams 11*a*–11*d* are embodied in such a manner that both in the bottom dead center position and in the top dead center position the pump piston 14*a*–14*d* remains unmoving for a relatively long time; this assures that when one of the control slides 24 is actuated another control slide will not also be affected, because both in the bottom dead center position and in the top dead center position the annular groove 43 on the pump piston 14*a*–14*d* closes the connection from the pressure chamber 28 via the control line 29 to the common control pressure line 31. In the illustrated exemplary embodiment, the individual pump/nozzles 10*a*–10*d* are actuated directly by the drive cams 11*a*–11*d* which are connected and driven by the camshaft 11 indicated by dot-dash lines and preferably embodied by the overhead engine camshaft. As a result, the "stiff drive" required for generating high injection pressures is assured. Naturally, the pump pistons 14*a*–14*d* may also be driven via tilting levers known per se by the drive cams 11*a*–11*d* (not shown). A spatially favorable arrangement of the entire fuel injection apparatus results if, as suggested by dot-dash lines on the supply pump 33, the pump 33 is also driven by the engine camshaft 11.

In the further exemplary embodiments described in connection with FIG. 2–4, identical elements or elements having the same function are given identical reference numerals; elements which are structurally modified are given a prime, and new elements are given new reference numerals.

Figure 2:
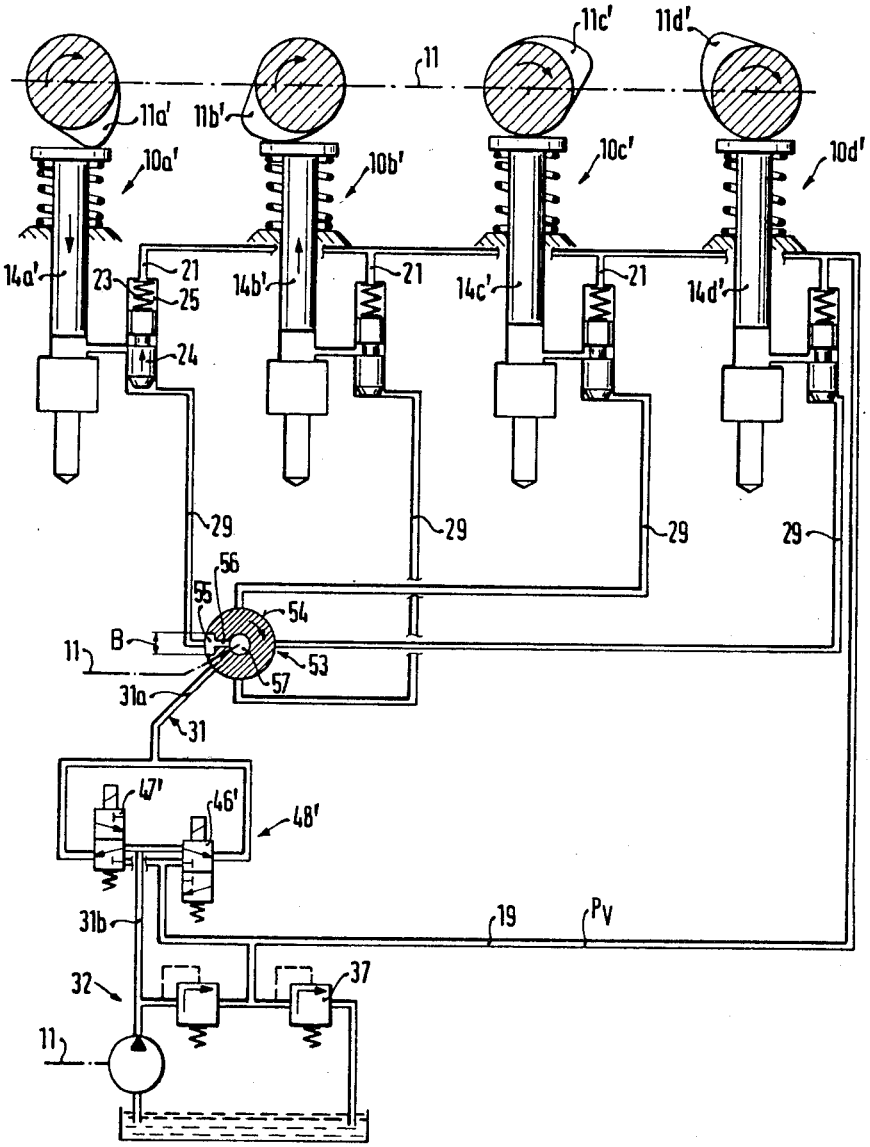
FIG. 2 shows the second exemplary embodiment, having a magnetic valve assembly, two 3/2-way valves, and a distributor apparatus embodied by a rotary distributor.

In the second exemplary embodiment shown in FIG. 2, the pump pistons 14*a*′–14*d*′ of the pump/nozzle 10*a*′–10*d*′ are driven by drive cams 11*a*′–11*d*′ which differ in shape from the drive cams 11*a*–11*d* of FIG. 1. A central rotary distributor 53, driven in synchronism with the pump/nozzles 10*a*′–10*d*′, serves as the distributor apparatus and is likewise connected directly or indirectly with the engine camshaft 11. A jacket face 54 of this rotary distributor 53 is provided with a control port 55 which permanently communicates with the control pressure line 31; its width B, viewed in the circumferential direction, is designed for the maximum possible duration of actuation of the control slide 24, taking into consideration the rpm levels which occur under actual driving conditions. The control port 55 communicates permanently with the control pressure line 31 via a transverse bore 56 and the rotary distributor 53 and via a longitudinal bore 57, and when there is a rotary movement of the rotary distributor 55 in the clockwise direction as the pump/nozzles 10*a*′–10*d*′ are triggered, the individual control lines 21 are made to communicate in sequence, in synchronism with the injections, with the control pressure line 31 by means of the control port 55. The magnetic valve assembly inserted into the control pressure line 31 between the portion 31*a* leading to the distributor apparatus 53 and the portion 31*b* of this line 31 which is supplied by the source of control fuel 32 is indicated by reference numeral 48′ in FIG. 2. It comprises two 3/2-way valves 46′ and 47′, by means of which the one portion 31*a* of the control pressure line 31 which is in permanent communication with the distributor apparatus 53 can be connected alternatively with the other portion 31*b* of the control pressure line 31 communicating with the source of control fuel 32, or can be connected with the low-pressure or supply line 19. The first magnetic valve 46′, actuated in order to initiate the onset of injection, is shown in a switching position which prevents the discharge of the fuel from the control pressure line 31 into the low-pressure line 19 but permits the flow of the control fuel through from the source of control fuel 32 to the rotary distributor 53. The second magnetic valve 47′ has already assumed the corresponding switching position and (not shown) the second magnetic valve 47′ can then switch over into a switching position enabling the relief of the control pressure $P_S$ in the portion 31*a* of the control pressure line 31 leading to the rotary distributor 53, in order to terminate the injection. In this switching position, a connection is then furnished to the supply line 19, in which the supply pressure $P_V$ which is substantially lower than the control pressure $P_S$ prevails, this pressure being controlled by the pressure limitation valve 37 as described above in connection with FIG. 1.

Figure 3:
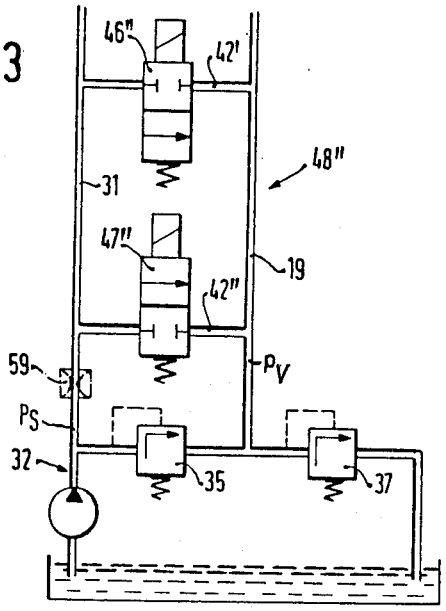
FIG. 3 is a detail of the third exemplary embodiment, otherwise embodied like that shown in FIG. 1, having a simplified magnetic valve assembly.

FIG. 3 shows a magnetic valve assembly 48″ for the third exemplary embodiment which has been simplified in terms of switching technology and which can be used in place of the magnetic valve assemblies 48 or 48′ of FIGS. 1 or 2. This magnetic valve assembly 48″ comprises two virtually identical magnetic valves 46″ and 47″ embodied as 2/2-way valves. The other components of the fuel injection apparatus may be embodied in accordance with FIG. 1 or FIG. 2.

Both magnetic valves 46″ and 47″ are inserted, each in a line 42′ and 42″, respectively, connecting the control pressure line 31 with the supply line 19. In accordance with the switching positions of the magnetic valves in FIGS. 1 and 2, the first magnetic valve 46″ is in its second switching position, with the electromagnet excited, blocking the connection from the control pressure line 31 to the low-pressure line 19; meanwhile, the second magnetic valve 47″, which is not excited, is already located in its first switching position, blocking this connection. As may be seen from FIG. 3, the control pressure line 31 communicates directly with the control fuel source 32, and the supply line 19 branches off between the two pressure limitation valves 35 and 37. In order to improve the functioning of the valve assembly 48″, a flow throttle 59 can be inserted into the control pressure line 31, as indicated by dot-dash lines, ahead of the connection with the supply line 19 effected via the lines 42′ and 42″. This flow throttle 59 must be dimensioned such that a pressure drop to the supply pressure $P_V$, enabling the return stroke of the control slide 24, is possible in the control line 31 when the connection with the supply line 19 has been controlled by the second magnetic valve 47″, and it must further be so dimensioned that even when there is a blocked outflow a rapid pressure buildup of the control pressure $P_S$ will still occur in this control pressure line 31.

Figure 4:
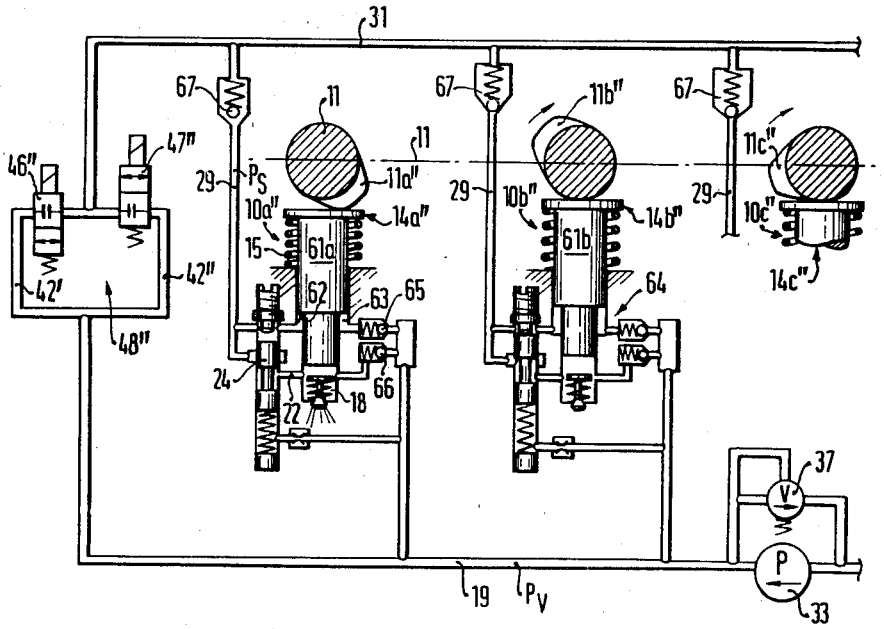
FIG. 4 shows the fourth exemplary embodiment.

In the fourth exemplary embodiment shown in FIG. 4, only three pump/nozzles 10*a*″–10*c*″ are shown, along with the associated drive cams 11*a*″–11*c*″ which are connected together by the engine camshaft 11. These pump pistons 14*a*″–14*c*″, of which only two are entirely shown, are embodied as differential pistons, with the section having the smaller diameter being designated in the following text and in the drawing as well as a pump piston 14*a*″, 14*b*″ and the section having the larger diameter is designated as the auxiliary pump piston 61*a*, 61*b*. The auxiliary pump piston 61*a*, 61*b* may be made up of a separate piston inserted between the pump piston 14*a*″, 14*b*″ and the drive cams 11*a*″, 11*b*″ and may function in the manner of a driven push rod.

The auxiliary pump piston 61*a*, 61*b*, during its compression stroke generated counter to the push rod spring 15 by the drive cam 11, dips with an effective work face 62 embodied by the difference in surface area betweeen the auxiliary pump piston 61*a*, 61*b* and the pump piston 14*a*″, 14*b*″ into an auxiliary pump chamber 63 which has been enlarged relative to the cylinder bore 17 of the pump piston 14a'', 14b'', and thus embodies an auxiliary pump 64 serving as the source of control fuel.

Just like the pump work chamber 18 exposed to the pump piston 14a'', 14b'', the auxiliary pump chamber 63 is filled with fuel via filling valves 65 and 66, respectively, from the supply line 19 which is filled by the supply pump 33 and here as well serves as the low-pressure line. This fuel is then delivered into the control lines 29 during the compression stroke of the auxiliary pump piston 61a, 61b.

The control lines 29, which are of equal length for each pump/nozzle 10a''–10c'', are capable of being blocked relative to the control pressure line 31 by check valves 67 which should be considered as part of a distributor apparatus, whenever the connection from the control pressure line 31 to the supply line 19, which is under supply pressure $P_V$, is blocked by means of the magnetic valve assembly 48'', which comprises two magnetic valves 46'' and 47'' and functions as like that shown in FIG. 3, so that it is also given the same reference numeral. The drive cam 11a'' has already moved the pump piston 14a'' of the first pump/nozzle 10 so far that its auxiliary pump piston 61a has increased the pressure of the fuel in the control line 29 and in the control pressure line 31 connected therewith to the control $P_S$ and has pushed the control slide, here given reference numeral 24'', into the illustrated position in which it blocks the overflow line 22. The pressure waves bouncing back from the magnetic valves 46'' and 47'' can be uncoupled from the control line 29 which has just been placed under pressure by means of the check valve 67. At the same time, the control lines 29 which at this time are not under control pressure and which belong to the two pump/nozzles 10b'' and 10c'' driven by the drive cams 11b'' and 11c'' and located in their bottom dead center position, are separated by the associated check valves 67 from the control pressure line 31 which has been placed under pressure by the one actuated pump/nozzle 10a''. As may be seen from the simplified representation of FIG. 4, the magnetic valve assembly 48'' is made up of two electromagnetically actuated 2/2-way valves 46'' and 47'' switched hydraulically parallel, by means of which with an appropriate overlapping of the control signals extremely short control times are attainable which cannot be attained with a single magnetic valve.

Figure 5:
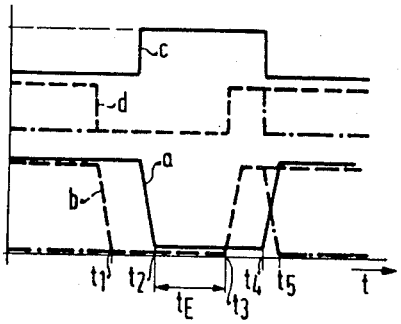
FIG. 5 is a control diagram for the various magnetic valve assemblies shown in FIGS. 1–4.

The mode of operation of the two magnetic valves 46 and 47 shown in FIG. 1 in their switching position blocking the discharge from the control pressure line 31 and the magnetic valves 46' and 47' and 46'' and 47'' described in connection with FIGS. 2, 3–4 may be understood from the diagram given in FIG. 5, and will be described below with the aid of this diagram in terms of one injection procedure.

On the ordinate, the closed position "zu" and the opened position "auf" of both magnetic valves 46 and 47, 46' and 47' or 46'' and 47'', respectively is plotted over the time t given in the abscissa by means of two curves a and b shown at slightly different levels. The solid-line curve a relates to the first magnetic valve 46, 46', 46'', while the broken-line curve b refers to the second magnetic valve 47, 47', 47''. As may be seen from curve b, at $t_1$ the second magnetic valve 47, 47', 47'' is already closed when at time $t_2$ the injection, identified by the symbol $t_e$ is initiated by means of the switchover of the first magnetic valve 46, 46', 46'' from its open position to its closed position, that is, from "auf" to "zu". The injection is then terminated when at time $t_3$ the second magnetic valve 47, 47', 47'' opens and switches over from "zu" to "auf". Shortly thereafter, the first magnetic valve 46, 46', 46'' can also switch over at time $t_4$ back into its open position, so that before the beginning of the closing movements of the two magnetic valves which occur at times $t_1$ and $t_2$, both magnetic valves are open and the control pressure line 31 is relieved toward the low-pressure line 19. As a result of this so-called "counterpoint switching" of two magnetic valves, pressure-compensated magnetic valves which are conventionally available on the market and which has a system-dictated minimum switchover time can be used even for extremely short switching times, that is, switching times which have been shortened to virtually zero. The switching times dictated solely by the stroke of the valve member are indicated by the oblique position of the corresponding portions of the curves a and b, and curves c and d indicate the electronic switching pulses for the associated electromagnet. As may be seen from curves c and d, the first magnetic valve 46, 46', 46'' is switched on shortly before time $t_2$ in order to control the injection onset, and it is shut off again at an instant which can be fixed within wide limits between $t_3$ and $t_2$. The broken-line curve d illustrates that the second magnetic valve 47, 47', 47'' switches on at time $t_3$ in order to control the termination of injection and is switched off again before time $t_2$, for example, or at $t_1$ or at $t_3$, the last time being indicated by a dot-dash line.

The fuel injection apparatuses described as exemplary embodiments are provided exclusively with pump/nozzles, because with such pump/nozzle units the advantages of the hydraulic control according to the invention are best attained. However, the principles of the invention can also be applied with single pumps and with injection pumps which are combined to make series-type pumps.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection apparatus for internal combustion engines, in particular for Diesel engines, having per engine cylinder one mechanically driven pump piston of an injection pump and a pump work chamber in said injection pump supplied with fuel under supply pressure by a supply pump and preferably combined with an injection nozzle into a pump/nozzle unit, each apparatus having one control slide, said slide being limited by a pressure chamber and actuatable by the control pressure of a source of control fuel counter to the force of at least one restoring spring, said control slide further being inserted into a discharge channel in permanent communication with said pump work chamber and arranged to close this discharge channel in response to said control pressure in order to initiate a variable onset of injection and further arranged to open it again in order to terminate the injection, said apparatus further including a control apparatus for all the injection pumps, whereby said control pressure can be exerted via control lines upon said pressure chambers of said control slides, characterized by the following characteristics:

(a) said control apparatus comprises a magnetic valve assembly common to all of said injection pumps and arranged to determine the onset and duration of said control pressure upon the pressure chambers of said control slides and a separate distributor apparatus, said distributor apparatus arranged to connect, said control lines of said pressure chambers in sequence with a control pressure line;

(b) said control pressure line common to all of said injection pumps can be made to communicate with a low-pressure line by means of said magnetic valve assembly;

(c) said control pressure ($P_S$) required for actuation of said control slides and exerted via said distributor apparatus upon one of said pressure chambers at a time is built up by means of the magnetic valve assembly which blocks said discharge of said fuel out of the control pressure line into the low-pressure line and is subsequently relieved toward said low-pressure line for the return stroke of the control slide; and further wherein (d) said magnetic valve assembly comprises two parallel actuated, switchable, magnetic valves the first of said magnetic valves being open toward said low-pressure line before the onset of injection said first valve arranged to block the discharge of said control fuel out of said control pressure line into said low-pressure line when said second magnetic valve is already blocking fuel discharge before the onset of injection, in order to initiate the injection, and further wherein said second magnetic valve controls the termination of injection by means of its switching movement enabling said discharge, while said first magnetic valve is still in a switchover position.

2. A fuel injection apparatus as defined by claim 1, characterized in that said first and second magnetic valves aare embodied as 3/2-way valves, and further wherein said control pressure line has a portion arranged to communicate permanently with said distributor apparatus, said valves further arranged to communicate with another portion of said control pressure line connected to the source of control fuel as well as with said low-pressure line. (FIG. 2).

3. A fuel injection apparatus as defined by claim 1, characterized in that said first magnetic valve is embodied as a 2/2-way valve and is inserted into a line which connects said control pressure line with said low-pressure line and that said second magnetic valve is embodied as a 3/2-way valve and said control pressure line has several portions, a first of which alternatively is connected with said distributor apparatus while another portion of said control pressure line is connected with said control fuel source as well as with said low-pressure line. (FIG. 1).

4. A fuel injection apparatus as described by claim 1, characterized in that said first and second magnetic valves are embodied as 2/2-way valves, each of which are each inserted into one line that connects said control pressure line with said low-pressure line and open or block said lines alternatively. (FIGS. 3, 4).

5. A fuel injection apparatus as described by claim 4, characterized in that a flow throttle is inserted into said control pressure line between said source of control fuel and the connection with said lines containing said magnetic valves. (FIG. 3).

6. A fuel injection apparatus as defined by claim 1, characterized in that said first magnetic valve is excited to trigger the onset of injection and block the connection from said control pressure line to said low-pressure line and said second magnetic valve is excited to control the termination of injection and relieve said control pressure line toward said low-pressure line.

7. A fuel injection apparatus as defined by claim 1, characterized in that said pump work chambers are connected via filling lines separated from said control lines to a supply line which is common to all of said injection pumps and that said pump work chambers are under supply pressure ($P_V$), and further that said supply line serves as said low-pressure line for the fuel flowing out via the magnetic valve assembly from said control pressure line.

8. A fuel injection apparatus as defined by claim 1, including a central rotary distributor serving as the distributor apparatus which is driven in sychronism with said injection pumps and which in order to actuate the control slides in sequence in sychronism with the injections establishes and then interrupts the connection of the individual control lines with said control pressure line, characterized in that said rotary distributor has a jacket face provided with a control port arranged to permanently communicate with said control pressure line, the width (B) of which said control port is dimensioned for the longest possible actuation duration of the control slide. (FIG. 2).

9. A fuel injection apparatus as defined by claim 1, characterized in that said distributor apparatus comprises one each control location machined into said pump pistons each of said control locations further arranged to interrupt the connection from the associated control line to the control pressure line and then reestablish said connection again after a first partial stroke ($h_1$) has taken place. (FIG. 1).

10. A fuel injection apparatus as defined by claim 9, characterized in that said control location comprises an annular groove.

* * * * *